US005086888A

United States Patent [19]

Chu

[11] Patent Number: 5,086,888

[45] Date of Patent: Feb. 11, 1992

[54] FOLDING SUITCASE WITH HARD CASING

[76] Inventor: Chung-Nan Chu, No. 7, Alley 10, Lane 172, Chung Hsing St., Chungho City, Taipei Hsiang, Taiwan

[21] Appl. No.: 579,078

[22] Filed: Sep. 7, 1990

[51] Int. Cl.[5] ..... A45C 7/00

[52] U.S. Cl. ..... 190/107; 190/127; 190/114

[58] Field of Search ..... 190/107, 127, 114

[56] References Cited

U.S. PATENT DOCUMENTS

| | | | |
|---|---|---|---|
| 2,425,035 | 8/1947 | Garnett et al. | 190/107 |
| 3,881,580 | 5/1975 | Doppelt | 190/114 |
| 4,160,496 | 7/1979 | Knight | 190/107 |
| 4,529,069 | 7/1985 | March | 190/127 |
| 4,588,056 | 5/1986 | Bernbaum | 190/107 |
| 4,655,329 | 4/1987 | Kaneko | 190/107 |
| 4,951,818 | 8/1990 | Johnson | 190/127 X |

FOREIGN PATENT DOCUMENTS

| | | | |
|---|---|---|---|
| 640473 | 5/1962 | Canada | 190/127 |

*Primary Examiner*—William I. Price
*Attorney, Agent, or Firm*—Brooks Haidt Haffner & Delahunty

[57] ABSTRACT

A folding suitcase with hard casing consisting of six hard sides at least, wherein the plate bodies of hard casing on the bottom, left and right sides (i.e. bottom, left and right plate bodies) are separable from their corresponding soft surface materials so that these plate bodies become removable. The inner sides at the bottom of the left and right plate bodies are provided with grooves respectively to engage with two longitudinal sides of a bottom plate body, the inner sides at the tops of the left and right plate bodies are provided with hook-and-loop fasteners. A part protruding upward from the tops of the left and right soft surface materials each become a turnover body of which the inner side is also provided with the hook-and-loop fastener to be folded inward and tightly adhered to the foregoing hook-and-loop fasteners on the left and right plate bodies, so the upper and lower ends and the inner and outer sides of left and right plate bodies are tightly fixed and firmly assembled. When these hook-and-loop fasteners are disengaged from each other and the bottom, left and right plate bodies are removed, only the soft surface materials are left on the bottom, left and right sides of the suitcase which become foldable, so the suitcase as whole can be folded into a flat shape with its front and rear sides overlapping each other in order to reduce the space warehousing, shipping and storing it.

4 Claims, 4 Drawing Sheets

FOLDING SUITCASE WITH HARD CASING

BACKGROUND OF THE INVENTION

1. Field of the Invention

The present invention generally relates to a construction of a suitcase with a hard casing, and particular to such suitcase construction which is foldable and may be folded into a flat shape, required for warehousing, shipping and storing same.

2. Description of the Prior Art

Advances in scientific technology and the escalation in the pace of living have promoted the conversion of old-fashioned closed societies into open ones tending to greater interpersonal communications which are more frequently than ever before. Therefore, the social or even the international artery as a whole is booming, and "a remote plave as a neighbourhood" is not unthinkable anymore. In such open societies, interpersonal communications in the form of business tours or travel at home and abroad is quite usual and not uncommon. However, regardless of the nature of travel, some daily necessities or tools for business must be brought, and these necessities or tools have to be portable, so the portable handbag and suitcase (or travelling case) capable of containing these necessities or tools become a necessary appliance for travel away from home.

Generally speaking, most of handbags are soft and do not occupy too much space but cannot fully protect the articles contained therein because their shape is uncertain and they have no hard casing to protect the clothing contained therein from becoming wrinkled and important books or articles contained therein from being damaged.

The suitcase in general has a hard casing and its advantage and disadvantage are opposite those of soft handbags or luggage. Its advantage consists in a fixed space protected by its hard casing so as to keep the articles contained therein intact, and its disadvantage is that such a space is fixed and occupies a constant space at all times which cannot always be effectively used. Also such hard suitcases increase the manufacture's indirect cost for warehousing and shipping same, and the selling price of suitcases with hard casings are invariably increased for these reasons.

SUMMARY OF THE INVENTION

The present invention is designed to improve the foregoing drawbacks of soft handbags and hard casing suitcases in general. The object of the present invention is to offer a folding suitcase with a hard casing which has the advantage of both the suitcases with hard casings and the soft handbags but does not possess the disadvantages thereof. In other words, the present invention has the protective function of suitcases with hard casings but can be easily folded to reduce the space for storing it while not to use it.

The present invention is characterized by the following structural design. The folding suitcase has six hard or rigid sides wherein the associated hard plate bodies and soft surface materials on the bottom, left and right sides are separable from each other, so when the bottom, left and right plate bodies are removed from these soft surface materials, only these soft surface materials are left on the bottom, left and right sides of the suitcase, and these bottom, left and right sides become foldable. Therefore, the suitcase as a whole can be folded into a flat shape with its front and rear sides overlapping together so as to considerably reduce the space for warehousing, shipping and storing it.

The present invention is further characterized by the following structural design. The inner side at the bottom of both the left plate body and the right plate body is provided with a groove to engage with each of two longitudinal sides of the bottom plate body, the inner side at the top of both the left plate body and the right plate body is provided with an assembling device. A part protruding upward from the top of both the left soft surface material and the right soft surface material forms a turnover body of which the inner side is also provided with an assembling device, so it is very easy to fold the turnover body inward and engage the assembling device of the turnover body with the assembling devices of both left and right plate bodies or to unfold the turnover body upward and disengage the assembling device of the turnover body from the assembling devices of both left and right plate bodies so as to finish the assembly or disassembly of the plate bodies and their surface materials. After the assembly of left and right plate bodies, the upper and lower ends and the inner and outer sides of the left and right plate bodies are tightly fixed, so this assembly is strong and rigid.

BRIEF DESCRIPTION OF THE DRAWINGS

FIGS. 2 to 5 shows schematic views of the suitcase of the present invention illustrating different steps in the folding process, wherein:

FIG. 2 shows the removal of the hook-and-loop fastener.

FIG. 3 shows the removal of the hook-and-loop fasteners on both sides and then removing the movable bottom, left and right plate bodies from the suitcase.

FIG. 4 shows the suitcase in a folded state after the foregoing plate bodies are removed;

FIG. 5 shows folding the suitcase into a flat collapsed form.

DETAILED DESCRIPTION OF THE PREFERRED EMBODIMENT

Figure 1:
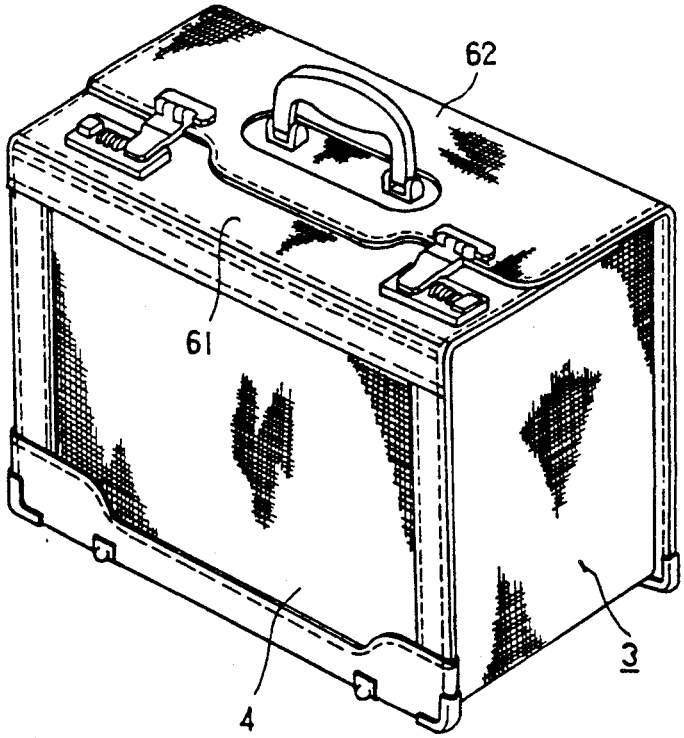
FIG. 1 is a perspective view of the suitcase in accordance with the present invention.
Figure 3:
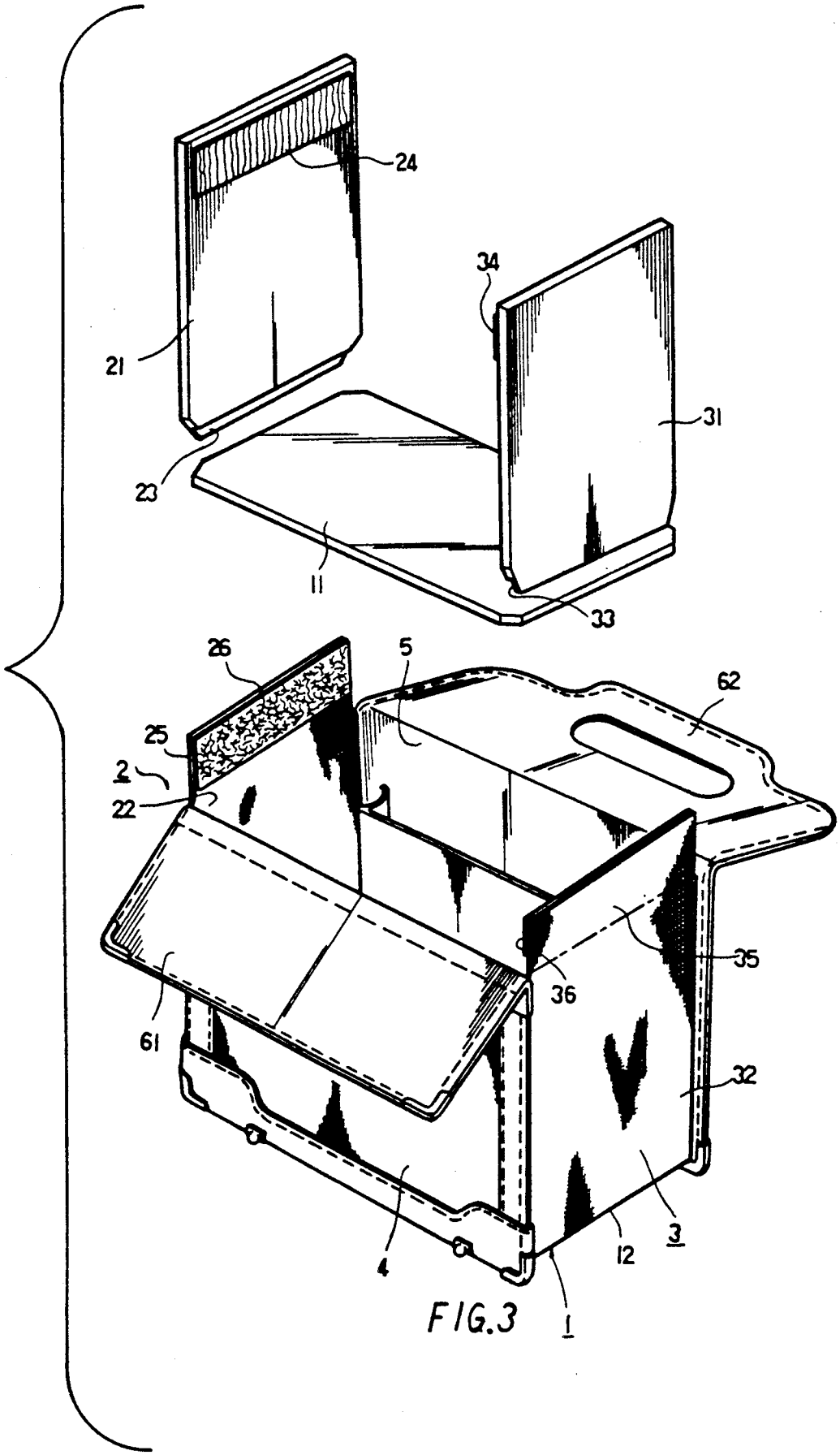

From FIG. 1, which depicts the suitcase when assembled in accordance with the present invention, and FIG. 3, which shows a breakdown view of the suitcase when disassembled, the major structural elements thereof can be ascertained. As shown in FIGS. 1 and 3, the present invention consists of at least six side plates, including a bottom plate 1, a left plate 2, a right plate 3, a front plate 4, a rear plate 5 and a front top plate 61 and a rear top plate 62 overlapping each other when assembled. All these plates are made of hard casing material. Bottom, left and right plates bodies cooperate with soft surface material and are separable from each other. Thus, the bottom plate body 11, left plate body 21 and right plate body 31 are separable from their associated bottom soft surface material 12, left soft surface material 22 and right soft surface material 32, respectively.

The inner sides at the bottoms of left plate body 21 and right plate body 31 are provided with grooves 23, 33, respectively, to engage with two longitudinal sides or lateral edges of bottom plate body 11. The inner sides at the tops of the left plate body 21 and right plate body 31 are provided with assembling devices 24, 34, each top of left and right soft materials 22, 32 including an extension portion which becomes a turnover body 25, 35 the inner sides of which are also provided with assembling devices 26, 36. The assembly devices 26, 36 may be any structure capable of mutually engaging with or disengaging from the foregoing assembling devices 24, 34 of the plate bodies. However, the assembling devices 26, 36, 24, 34 are preferably hook-and-loop fasteners which can be easily adhered or torn off.

Figure 6:
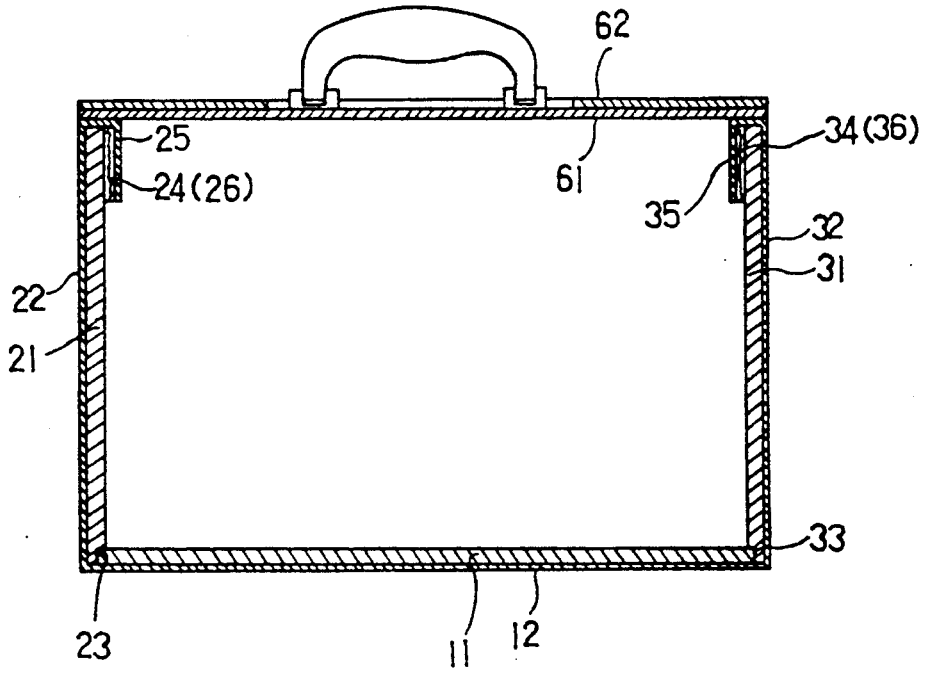
FIG. 6 is a cross section view of the suitcase in FIG. 1 taken along line 6—6.

When the suitcase is assembled in accordance with the present invention, the bottom plate body 11 is disposed on the bottom of the suitcase, the grooves 23, 33 at the bottoms of left and right plate bodies 21, 31 are engaged with the two longitudinal sides or lateral edges of the bottom plate 11, respectively, the turnover bodies 25 35 at the tops of the left and right soft surface materials 22, 32 are folded inward; then the hook-and-loop fasteners (assembling devices) 26, 36 of these turnover bodies 25, 35 are engaged with the hook-and-loop fasteners 24, 34 on the left and right plate bodies to each other, and the assembly of the suitcase is finished (as shown in FIGS. 1 and 6).

Figure 2:
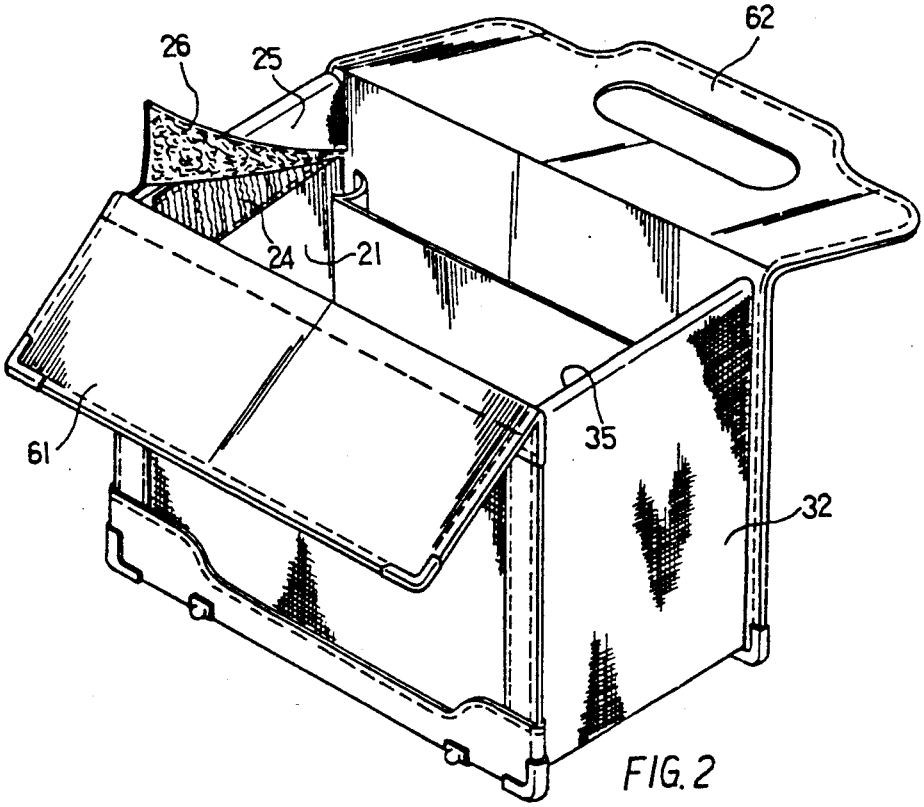
Figure 4:
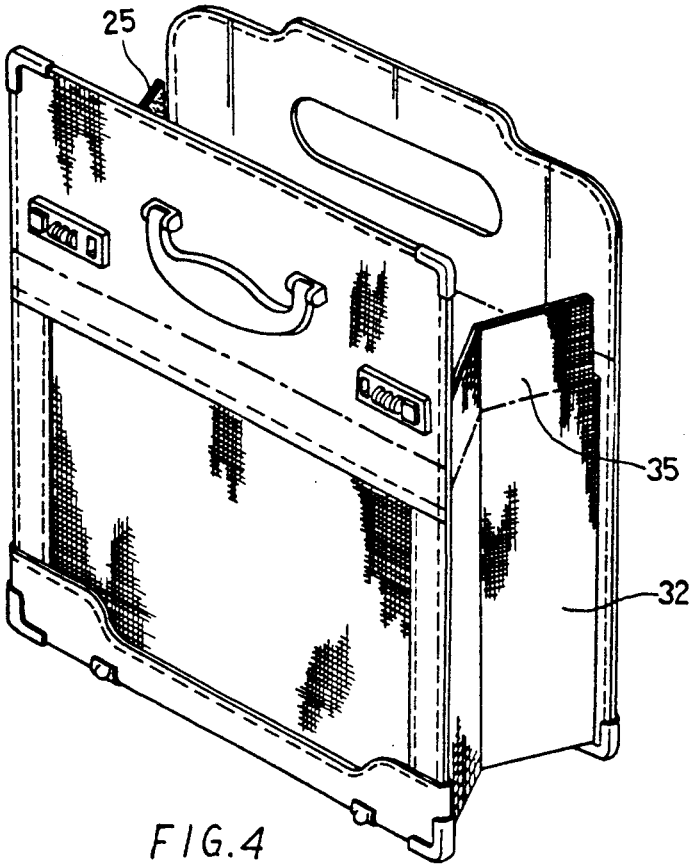
Figure 5:
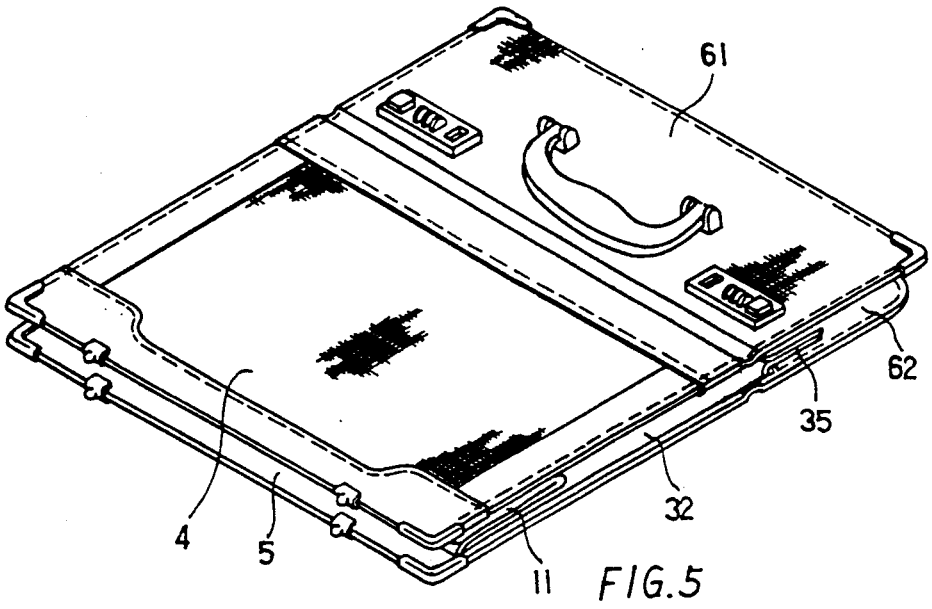

After the suitcase is assembled, so far as the inner side of left plate body 21 is concerned, the groove 23 at the bottom thereof is engaged with the left lateral edge of the bottom plate body 11, and the top thereof is tightly adhered by the hook-and-loop fastener 26 from up to down; and so far as the other side thereof is concerned, the left plate body 21 is tightly adhered to the left soft surface material 22 because of the tight adherence by the hook-and-loop fastener 26; so the left plate body 21 is secured internally and externally and will never be easily moved. So far as the right plate body 31 is concerned, it is in the same state. So after the assembly of the movable left and right plate bodies 21, 31 is finished, the upper and lower ends and the inner and outer sides thereof are tightly fixed, and such a strong assembly will never incline. When the suitcase of the present invention is not to be used, it can be folded into a flat shape so as to reduce its volume as shown in FIGS. 2 to 5. First, the hook-and-loop fasteners 26, 36 are separated and turned over (as shown in FIG. 2). The left and right plate bodies 21, 31 and the bottom plate body 11 can then be removed (as shown in FIG. 3), only the left, right and bottom soft surface materials 22, 32, 12 being left on the left, right and bottom sides of the suitcase. These left, right and bottom sides become foldable (as shown in FIG. 4), and the suitcase as a whole can be folded into a flat shape with its front and rear sides overlapping each other (as shown in FIG. 5). The left, right and bottom plate bodies removed previously can be flatly disposed between the front and rear sides) so as to considerably reduce the space to be occupied by the flat suitcase. Its manufacturers can reduce the space for warehousing and shipping such suitcases with hard casings in large quantities and lower their cost and selling price so as to benefit the consumers. For the shops and consumers in general, the space for storing or displaying the suitcases with such hard casing can be effectively reduced.

Based on the present invention, the advantage of the suitcase with a hard casing consists in well protecting the articles contained therein and reducing the volume per se through folding as well as easy operation and economical practicability.

I claim:

1. A folding suitcase having a hard casing consisting of at least six hard plate including hard bottom, left and right side plate bodies; soft surface materials associated with each of said bottom, left and right plate bodies, said plate bodies being movable but associated plate bodies substantially abutting against each other when the suitcase is assembled and can be engaged with the corresponding soft surface materials, respectively; and assembling devices for maintaining associated ones of said plate bodies in abutment when the suitcase is assembled, whereby disassembly of said plate bodies only requires said assembling devices to release said left and right plate bodies so that all said plate bodies can be removed and the soft surface materials on the bottom, left and right sides of the suitcase become foldable, and the suitcase as a whole can be folded into a flat shape with its front and rear sides overlapping each other.

2. A folding suitcase with hard casing as claimed in claim 1, wherein said assembling devices are hook-and-loop fasteners.

3. A folding suitcase having a hard casing consisting of at least six hard plates including hard bottom, left and right side plate bodies, soft surface materials associated with each of said bottom, left and right plate bodies, said plate bodies being movable but associated plate bodies substantially abutting against each other when the suitcase is assembled and can be engaged with the corresponding soft surface materials, respectively; and assembling devices for securing said left and right plate bodies, whereby disassembly of said plate bodies only requires removal of said plate bodies so that the soft surface materials on the bottom, left and right sides of the suitcase become foldable, and the suitcase as a whole can be folded into a flat shape with its front and rear sides overlapping each other, said bottom plate body having two opposing lateral sides extending along said left and right plate bodies when assembled, said inner sides at the bottom of both left and right plate bodies each being provided with a groove to engage said two lateral sides of said bottom plate body, the inner sides at the tops of said left and right plate bodies being provided with assembling devices, portions protruding upward from the tops of said left and right soft surface materials forming turnover bodies of which the inner sides are also provided with assembling devices, whereby said plate bodies and soft surface materials can be assembled or disassembled using said assembling devices on said turnover bodies to engage with or disengage from those assembling devices on said left and right plate bodies.

4. A folding suitcase with hard casing as claimed in claim 3, wherein said assembling devices are hook-and-loop fasteners.

* * * * *